US008740032B2

(12) United States Patent
Chan

(10) Patent No.: US 8,740,032 B2
(45) Date of Patent: Jun. 3, 2014

(54) ELECTRIC STAPLER

(75) Inventor: Kwok Ki Stephen Chan, Hong Kong (HK)

(73) Assignee: Lee Tack Stationary Manufactory Limited, New Territories (HK)

( * ) Notice: Subject to any disclaimer, the term of this patent is extended or adjusted under 35 U.S.C. 154(b) by 529 days.

(21) Appl. No.: 13/005,657

(22) Filed: Jan. 13, 2011

(65) Prior Publication Data

US 2012/0181321 A1 Jul. 19, 2012

(51) Int. Cl.

| | |
|---|---|
| ***B27F 7/19*** | (2006.01) |
| ***B27F 7/36*** | (2006.01) |
| ***B25C 5/02*** | (2006.01) |

(52) U.S. Cl.

CPC ..... *B27F 7/19* (2013.01); *B25C 5/0228* (2013.01); *B27F 7/36* (2013.01)

USPC ..... 227/131; 227/155; 227/77; 227/79

(58) Field of Classification Search

USPC ..... 227/155, 131, 77, 79

See application file for complete search history.

(56) References Cited

U.S. PATENT DOCUMENTS

| | | | | |
|---|---|---|---|---|
| 4,199,095 | A * | 4/1980 | Yamanoi | 227/125 |
| 4,844,319 | A * | 7/1989 | Kurosawa | 227/79 |
| 5,009,355 | A * | 4/1991 | Akizawa et al. | 227/114 |
| 5,758,813 | A * | 6/1998 | Kikuchi et al. | 227/155 |
| 5,791,543 | A * | 8/1998 | Udagawa et al. | 227/4 |
| 2004/0060959 | A1 | 4/2004 | Ura | |
| 2005/0161487 | A1* | 7/2005 | Motono et al. | 227/131 |
| 2005/0236458 | A1 | 10/2005 | Tsai | |
| 2006/0273134 | A1* | 12/2006 | Smith et al. | 227/131 |

FOREIGN PATENT DOCUMENTS

| | | | |
|---|---|---|---|
| EP | 0761392 | A | 3/1997 |
| WO | WO2005/115699 | A | 12/2005 |
| WO | WO2008/076036 | A | 6/2008 |
| WO | WO2008/136726 | A | 11/2008 |

OTHER PUBLICATIONS

European Search Report for corresponding EP Application 11250768, mailed May 16, 2012, 3 pages.

* cited by examiner

*Primary Examiner* — Michelle Lopez

(74) *Attorney, Agent, or Firm* — William J. Sapone; Ware Fressola; Maguire & Barber LLP

(57) ABSTRACT

An electric stapler (10) is disclosed as including a stapling head (12) with a driver (28), an intermediate magazine (14) for carrying staples each with two legs, a base part (16) carrying two anvils (44), cams (24), and eccentrically mounted wheels (52), in which the stapling head (12), intermediate magazine (14) and base part (16) are movable relative to one another, the eccentrically mounted wheels (52) are rotatable to move the stapling head (12) and intermediate magazine (14) relative to each other and relative to the base part (16) whereby the driver (28) of the stapling head (12) drives a staple away from the magazine (14), and the cams (24) are rotatable to move a movement transmission assembly (30) to move the anvils (44) to bend the legs of the staple.

12 Claims, 12 Drawing Sheets

ELECTRIC STAPLER

TECHNICAL FIELD

This invention relates to a stapler which is operable to drive a staple through a plurality of pieces of sheet material (e.g. paper) for stapling such pieces together.

BACKGROUND OF THE INVENTION

Most existing staplers include a stapling head, an intermediate magazine for carrying staples, and a base part, which are pivotally connected and movable relative to one another. In most such conventional staplers, when in use, a staple carried by the magazine is driven, by a driver at or adjacent a free longitudinal end of the stapling head, such that two parallel and spaced apart legs of the staple are forced through pieces of sheet material (e.g. paper). During the stapling action, the two legs of the staple are bent by an anvil carried by the base part towards each other and towards a crown of the staple joining the two legs. As the legs of the staple are bent whilst they are being driven through the pieces of sheet material, they will be curved after bending, which is neither satisfactory nor safe.

Thus, staplers have been developed which drive staples through pieces of sheet materials and the legs of the staples are straight after bending. Such conventional staplers (also known as "clinch staplers") usually employ a two-step process. In the first step of the stapling process, a staple is driven away from the magazine by a driver of a stapling head such that the legs of the staple are driven through the pieces of sheet material. In the second step of the stapling process, the stapling head actuates an actuator which causes a plate carried by the base part to be retracted to expose a space, thus allowing the driver of the stapling head to drive the staple further towards an anvil carried by the base part so as to bend the legs in a quick action, thus resulting in two straight bent legs which abut an undersurface of the pieces of sheet material. It is best to synchronize the actuating movement of the stapling head with the time when the legs of the staple are fully driven through the sheets of sheet material, so as to obtain a good straight-bending effect on the legs of the staple. Such of course requires precise machining of the various components of the staplers. In addition, it is also found in practice that it is very difficult to machine the plate carried by the base part to the appropriate dimensions to achieve the desired movement. In addition, the two steps of this stapling process are discontinuous and uncomfortable to a user.

It is thus an object of the present invention to provide a stapler in which the aforesaid shortcomings are mitigated, or at least to provide a useful alternative to the trade and public.

SUMMARY OF THE INVENTION

According to the present invention, there is provided a stapler comprising a stapling head with a driver, a magazine adapted to carry at least one staple with two legs, a base part carrying at least two anvil members, and at least one actuator, wherein said stapling head, said magazine and said base part are movable relative to one another, wherein said actuator is movable from a first position to a second position to move said stapling head and said magazine relative to each other and relative to said base part whereby said driver of said stapling head drives said staple away from said magazine, and wherein said actuator is movable from said second position to a third position to move a movement transmission assembly to move said anvil members to bend said legs of said staple.

BRIEF DESCRIPTION OF THE DRAWINGS

A preferred embodiment of the present invention will now be described, by way of example only, with reference to the accompanying drawings, in which.

DETAILED DESCRIPTION OF THE PREFERRED EMBODIMENT

Figure 1:
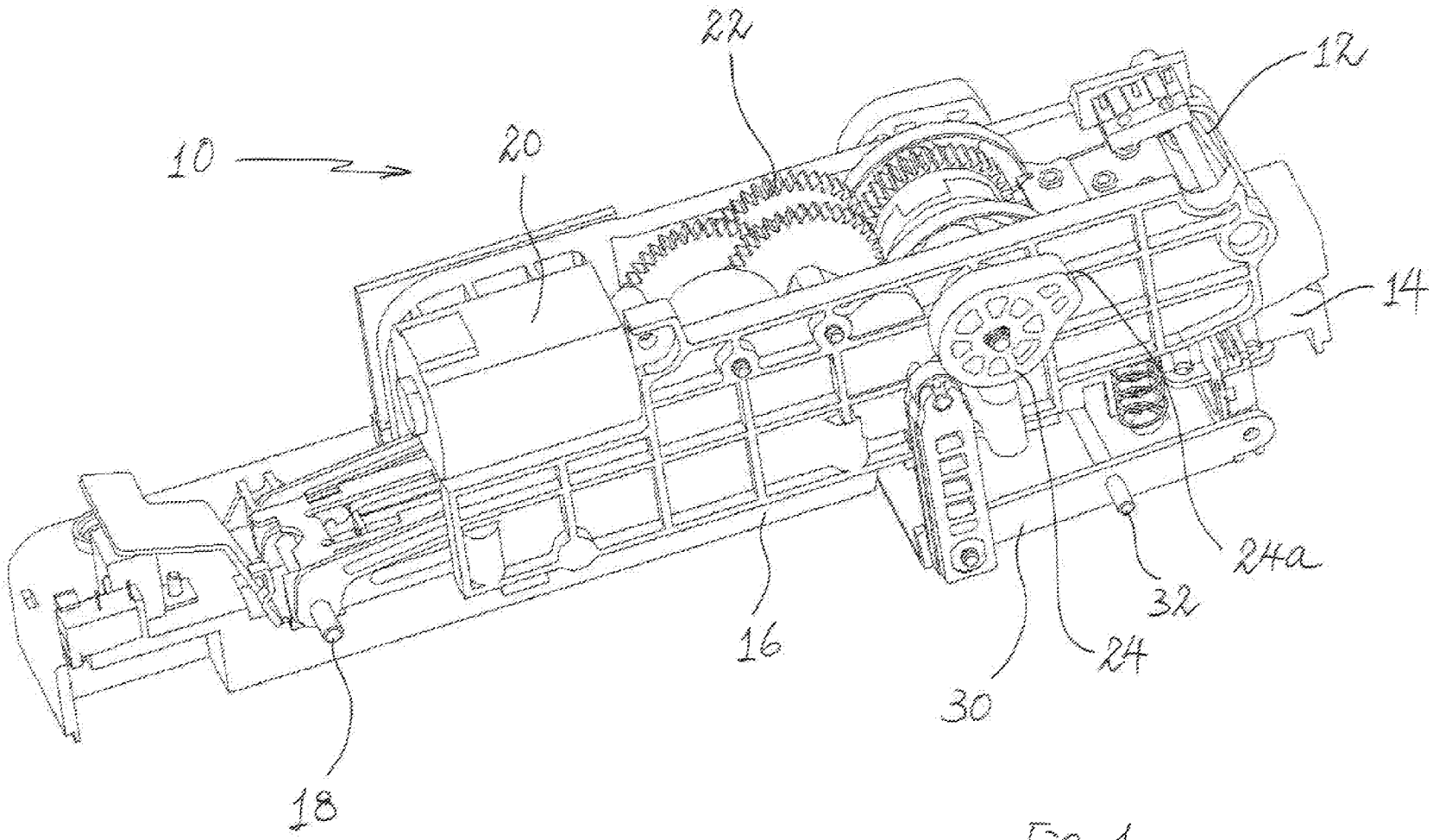
FIG. 1 is a top perspective view of an electric stapler according to a preferred embodiment of the present invention, with its outer casing removed for clarity.

An electric stapler according to a preferred embodiment of the present invention, with its outer casing removed for clarity, is shown in FIG. 1, and generally designated as 10. The stapler 10 has a stapling head 12, an intermediate staple magazine 14 and a base part 16 which are pivotally connected with one another about a pin 18 adjacent a rear end 20 of the stapler 10, so that the stapling head 12, the magazine 14 and the base part 16 are pivotally movable relative to one another.

Figure 2:
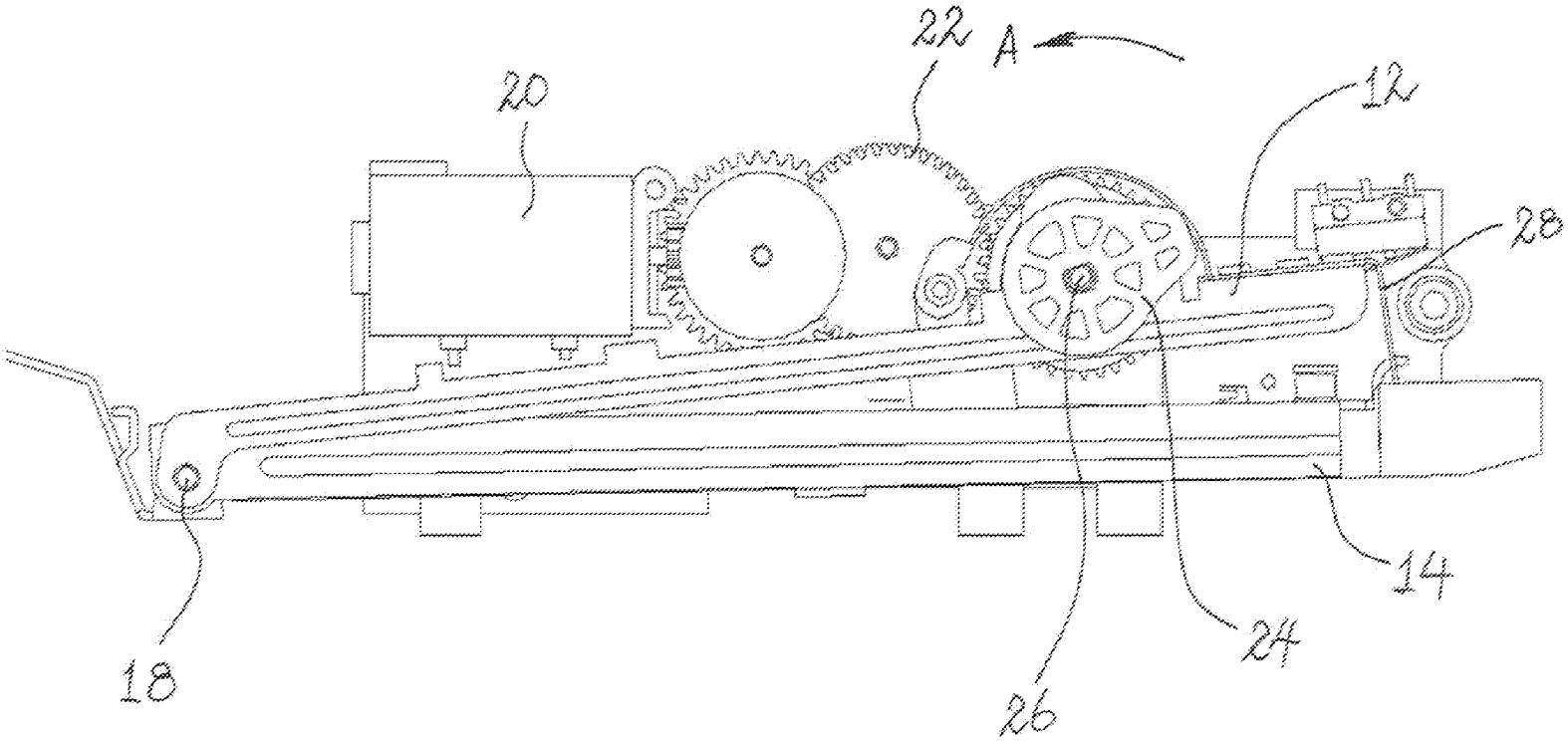
FIG. 2 is a side view of the stapler of FIG. 1 with the base part and movement transmission assembly removed.
Figure 3:
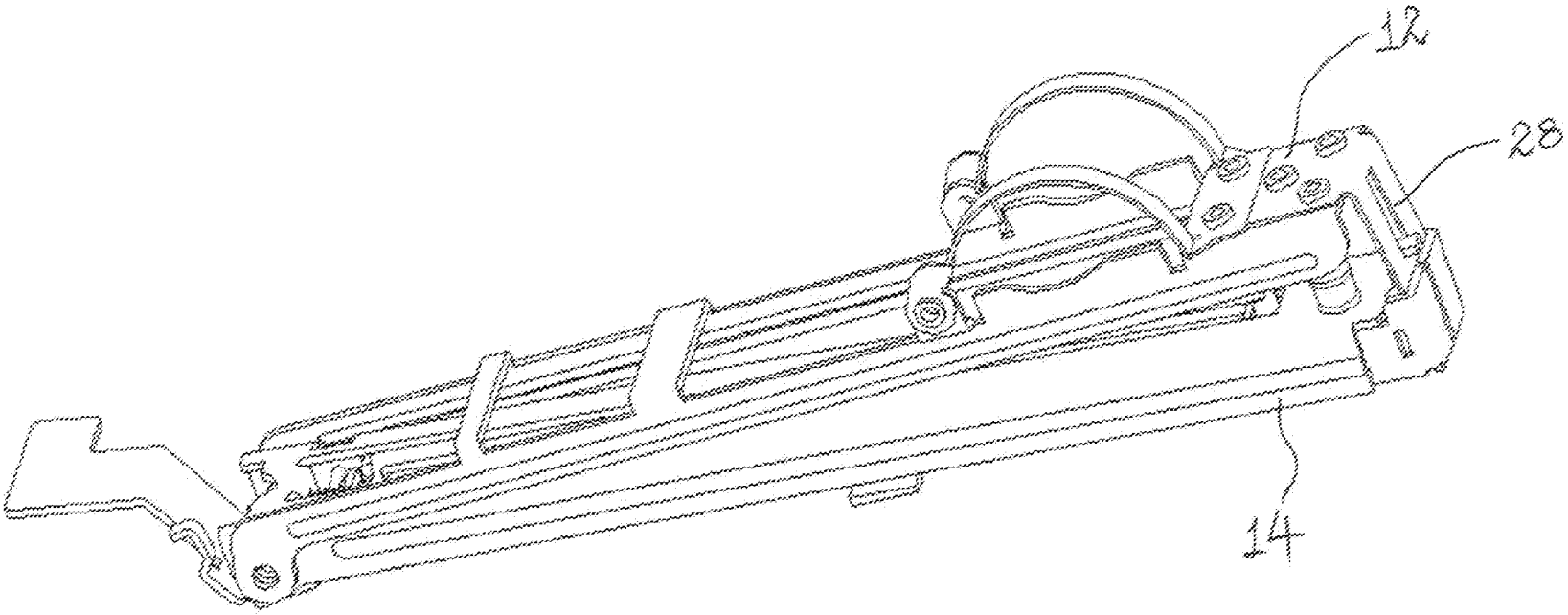
FIG. 3 is a top perspective view of the stapler of FIG. 2 with the motor, gear chain and cam removed.

The stapler 10 is operated by an electric motor 20 (which may be powered by batteries and/or ac. municipal power), whose output is transmitted by a gear chain 22 to two cams 24 (of which only one is shown in FIG. 1) each with a cam surface 24*a*, such that, upon running of the motor 20, the cams 24 are caused to rotate about an axle 26 fixed relative to the stapling head 12, and in the direction indicated by the arrow A in FIG. 2. It can also be seen from FIGS. 2 and 3 that a staple driver 28 is provided at a free front end of the stapling head 12.

As shown in FIG. 1, a movement transmission assembly 30 is pivotally attached to the base part 16 through an axle 32 fixed to the base part 16, such that the movement transmission assembly 30 is pivotally movable relative to the base part 16.

Figure 4:
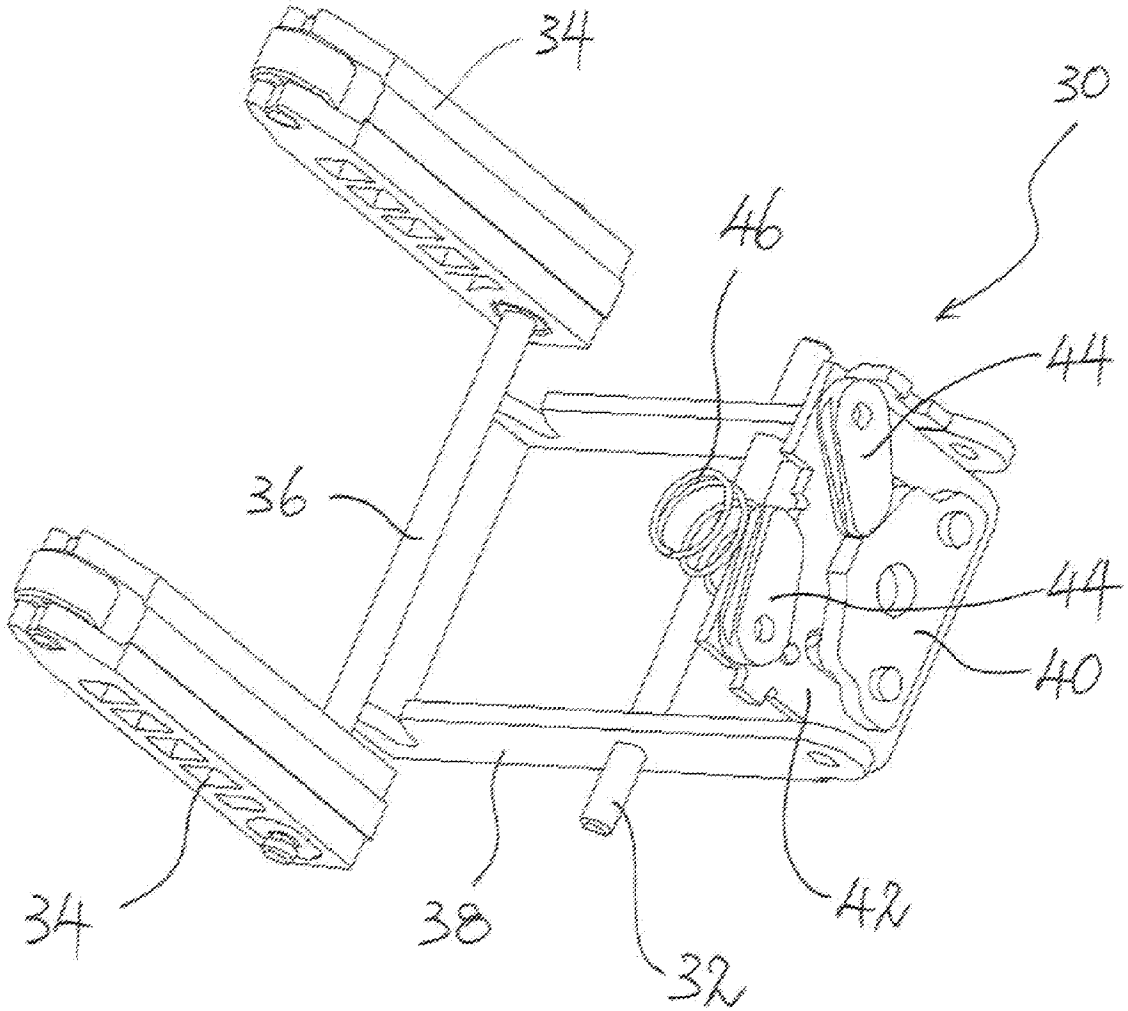
FIG. 4 is a top perspective view of the movement transmission assembly of the stapler of FIG. 1.

As shown in FIG. 4, the movement transmission assembly 30 has a pair of legs 34 pointing towards the stapling head 12 and pivotally engaged with and movable relative to an axle 36, which is fixedly engaged to one end of a frame 38, which also carries the axle 32. An opposite end of the frame 38 is pivotally engaged with and movable relative to a platelet 40. The platelet 40 is slidable on an outer major surface of a plate 42 to which two staple-bending anvils 44 are pivotally engaged for relative pivotal movement. The plate 42 is carried by the base part 16. A spring 46 is also provided for biasing the movement transmission assembly 30 to a stable position.

Figure 5:
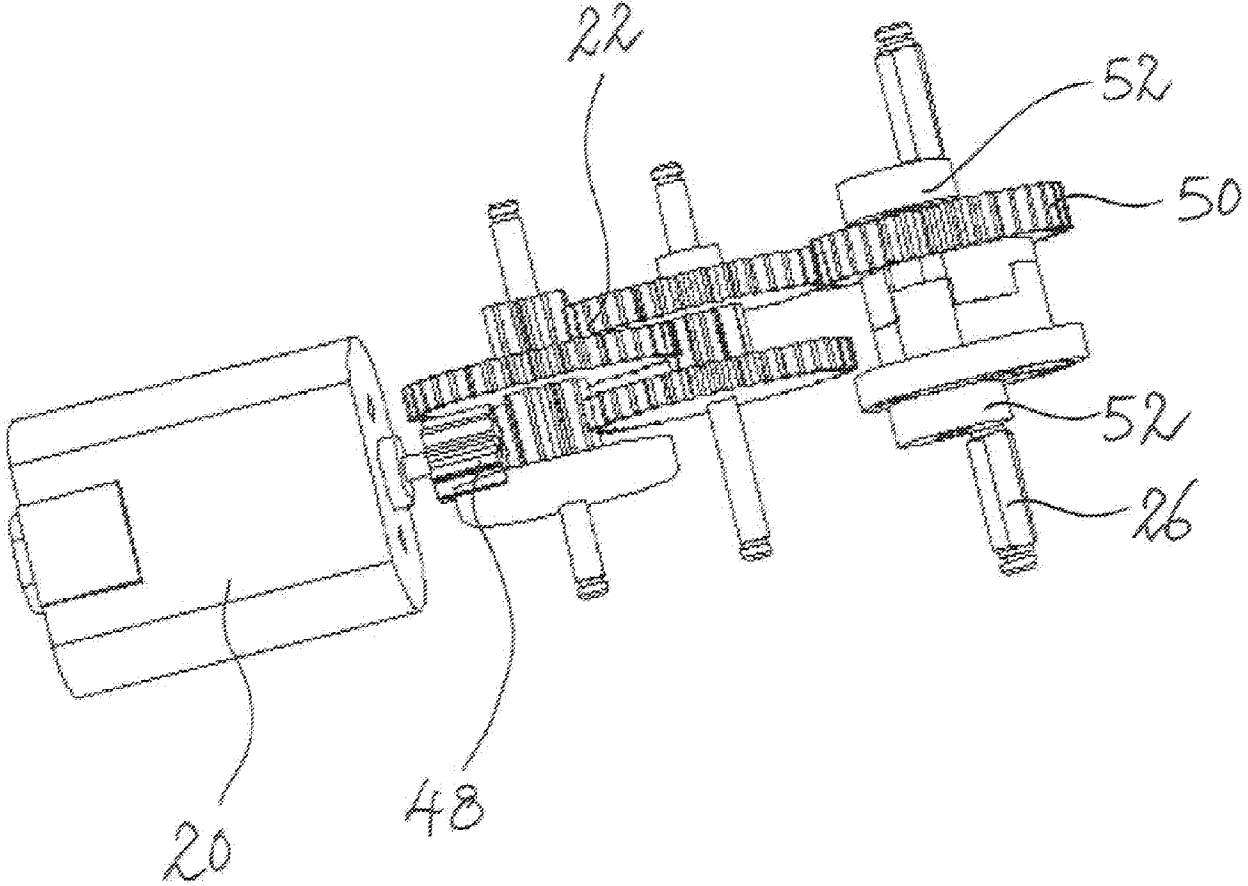
FIG. 5 is a top perspective of the motor and gear chain of the stapler of FIG. 1.

FIG. 5 shows in more detail the connection between the motor 20 and the gear chain 22. It can be seen that an output spindle 48 of the motor 20 is in mesh with the gear chain 22 to drive an end gear 50. The axle 26 is fixed through the central axis of the gear 50, and the cams 24 are fixedly engaged with the respective ends of the axle 26 for simultaneous rotational movement. Two wheels 52 are also eccentrically and fixedly mounted to the axle 26 for simultaneous rotational movement.

Figure 6B:
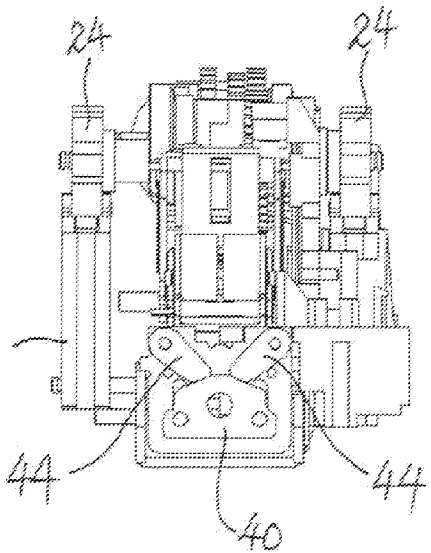
FIG. 6B is a front view of the stapler of FIG. 6A.
Figure 6A:
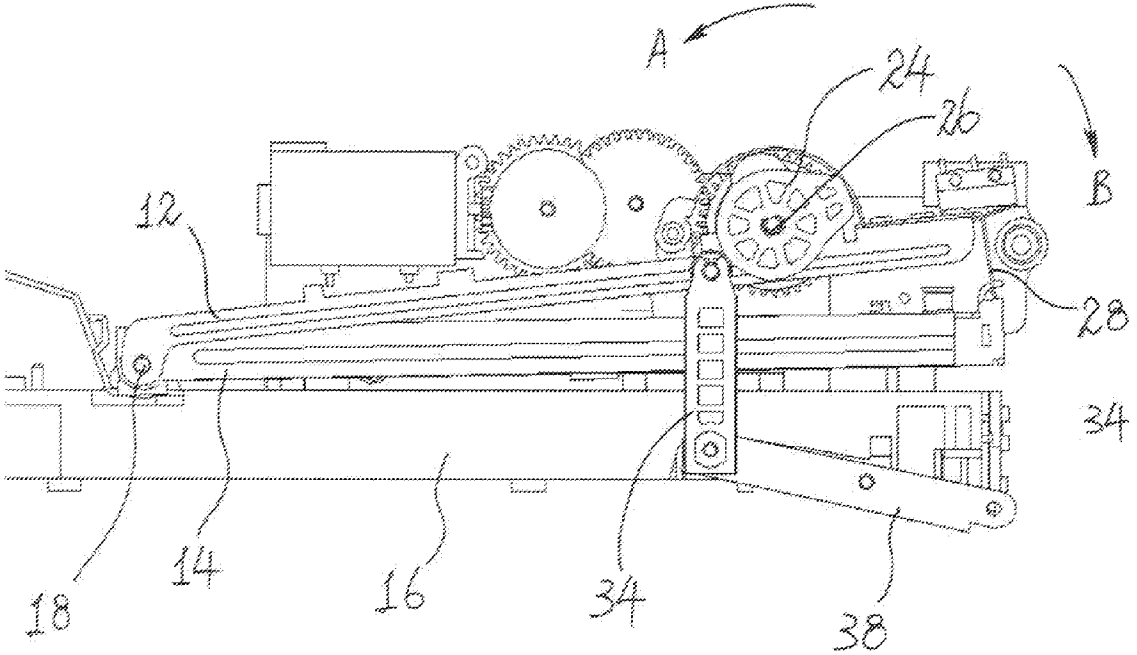
FIG. 6A is a side view of the stapler of FIG. 1 in a first configuration.

FIGS. 6A and 6B show the stapler 10 in its initial operation configuration. In this configuration, the cams 24 are in their initial position, the legs 34 are in their upper position, the platelet 40 is in its lower position, and the anvils 44 are also in their lower position.

When the motor 20 is operated, it will drive the cams 24 to rotate with and about the axle 26 relative to the stapling head 12 in the direction indicated by the arrow A in FIG. 6A. During this rotational movement, the eccentrically mounted wheels 52 are also caused to rotate about the axle 26. The rotational movement of the wheels 52 causes the stapling head 12 to pivot about the pin 18 in the direction indicated by the arrow B in FIG. 6A, relative to the magazine 14 and relative to the base part 16. The driver 28 of the stapling head 12 is thus moved into the magazine 14 to drive a staple of a staple stack carried by the magazine 14 away from the magazine 14. To drive the staple totally away from the magazine 14, the magazine 14 is also caused by the movement of the driver 28 to pivot about the pin 18 relative to the base part 16 in the direction indicated by the arrow B, until the stapler 10 is in the configuration shown in FIGS. 7A and 7B.

Figure 7B:
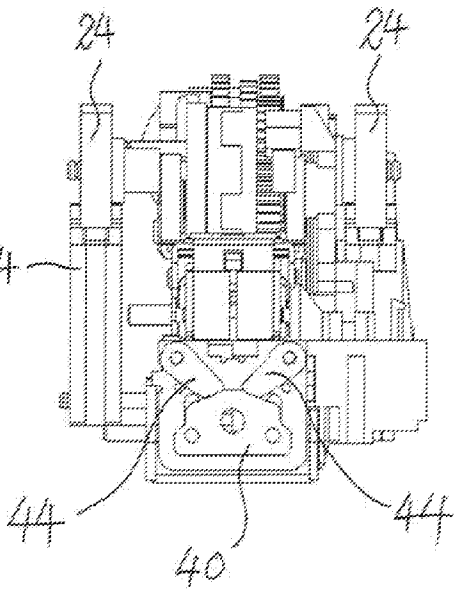
FIG. 7B is a front view of the stapler of FIG. 7A.
Figure 7A:
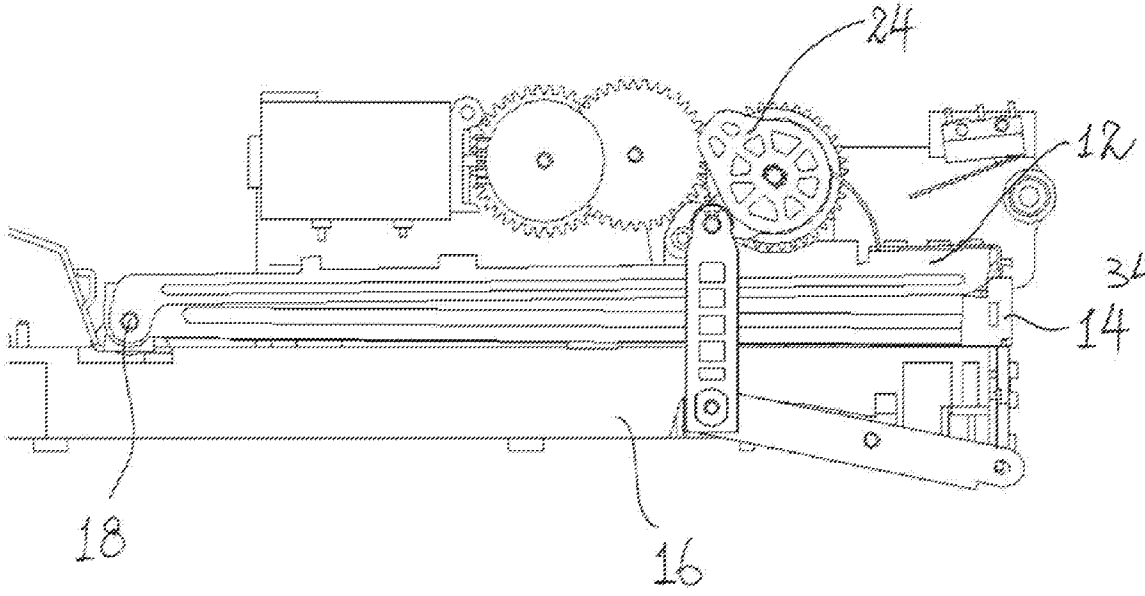
FIG. 7A is a side view of the stapler of FIG. 6A in a second configuration.

It can be seen that, when the stapler 10 is in the configuration shown in FIGS. 7A and 7B, the cams 24 have been rotated by a certain angle; the stapling head 12 and the magazine 14 have been pivoted towards the base part 16. In this configuration, the two legs of the staple driven by the driver 28 of the stapling head 12 have been fully punched through the pieces of sheet material to be stapled. The two legs of the staple are parallel with and spaced apart from each other and are generally perpendicular to a crown joining the two staple legs.

Figure 8B:
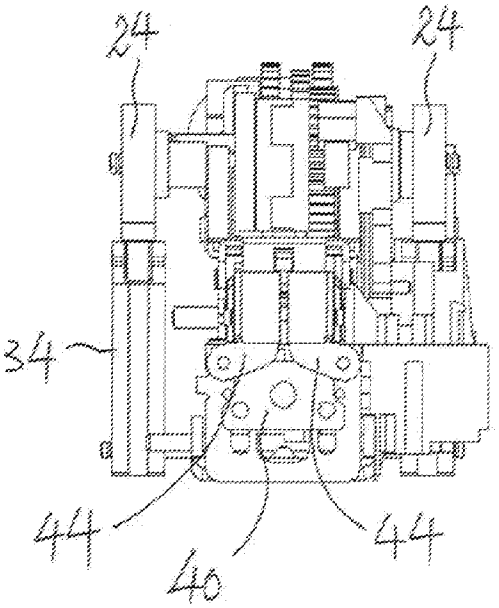
FIG. 8B is a front view of the stapler of FIG. 8A.
Figure 8A:
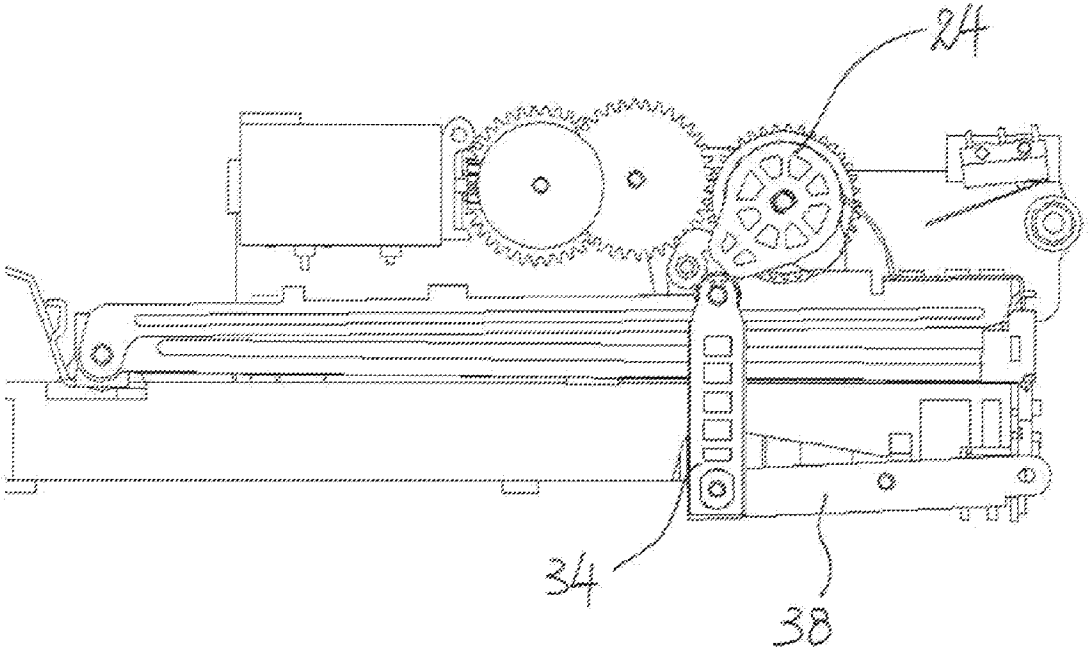
FIG. 8A is a side view of the stapler of FIG. 7A in a third configuration.

Upon further operation of the motor 20, and thus rotation of the cams 24 in the same direction, and as shown in FIGS. 8A and 8B, the cam surfaces 24*a* of the cam 24 act on the legs 34 carried by the frame 38. This causes the legs 34 to move from its upper position to its lower position. During this movement, and because of the linkage between the legs 34 and the platelet 40, the platelet 40 is caused to move from its lower position to its upper position (as shown in FIGS. 8A and 8B) along and relative to the outer major surface of the plate 42. This means that the legs 34 and the platelet 40 move in different directions.

When the platelet 40 is moved to its upper position, and as shown more clearly in FIG. 8B, it moves the two anvils 44 to pivot upwardly towards the stapling head 12, the intermediate magazine 14 and the staple, to bend the two staple legs towards each other until they generally lie on a common plane, pointing towards each other and on a lower surface of the pieces of sheet material so stapled. It is also arranged such that, during the bending of the two staple legs by the anvils 44, the wheels 52 act on the stapling head 12 to keep the stapling head 12 (and thus the driver 28) stationary relative to the magazine 14 and the base part 16. This results in a better straight-bending effect.

Figure 9B:
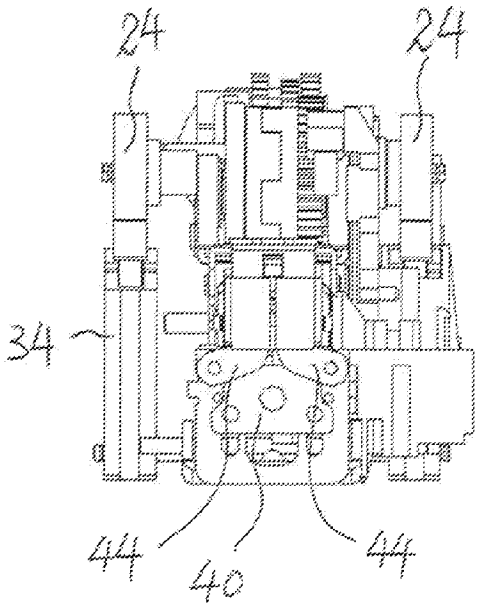
FIG. 9B is a front view of the stapler of FIG. 9A.
Figure 9A:
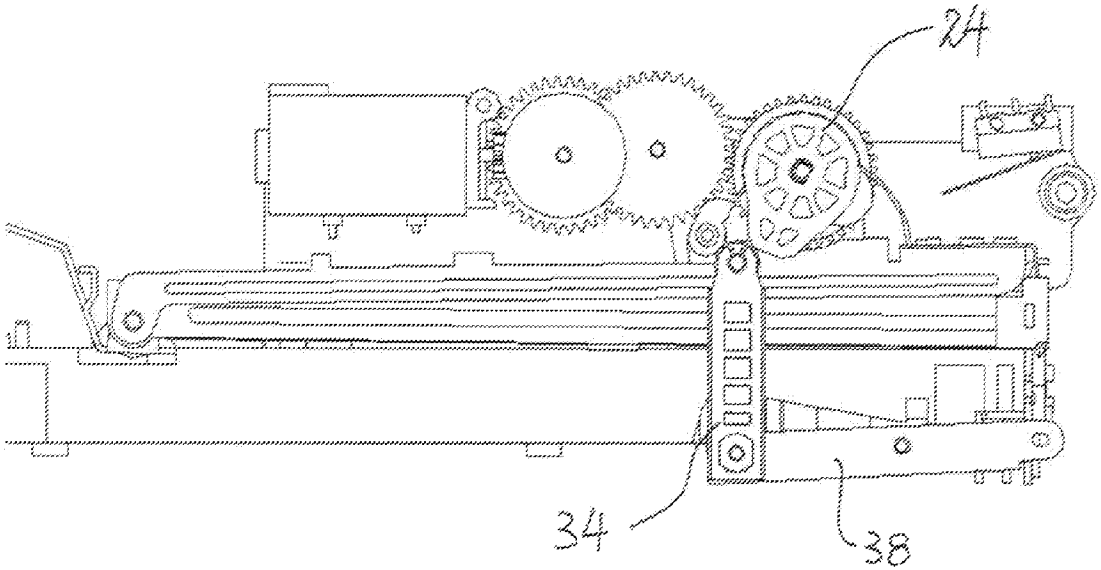
FIG. 9A is a side view of the stapler of FIG. 8A in a fourth configuration.

Upon further rotation of the cams 24 in the same direction indicated by the arrow A in FIG. 2 to the position shown in FIGS. 9A and 9B, the cam surfaces 24*a* are just out of touch with the legs 34. The legs 34 remain in their lower position, the platelet 40 remains in its upper position, and the anvils 44 remain in their upper position to which they have been pivoted.

Figure 10B:
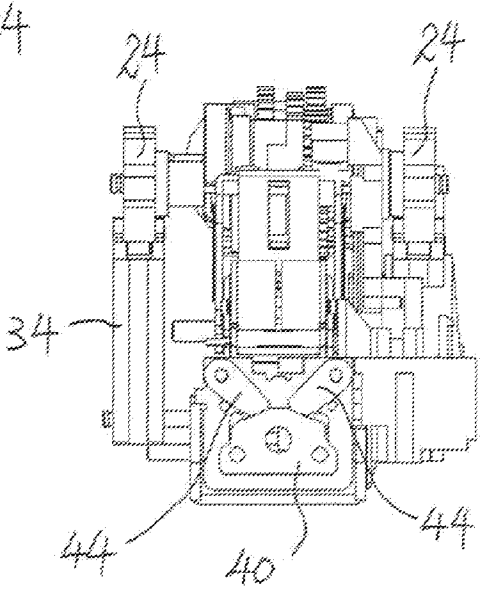
FIG. 10B is a front view of the stapler of FIG. 10A.
Figure 10A:
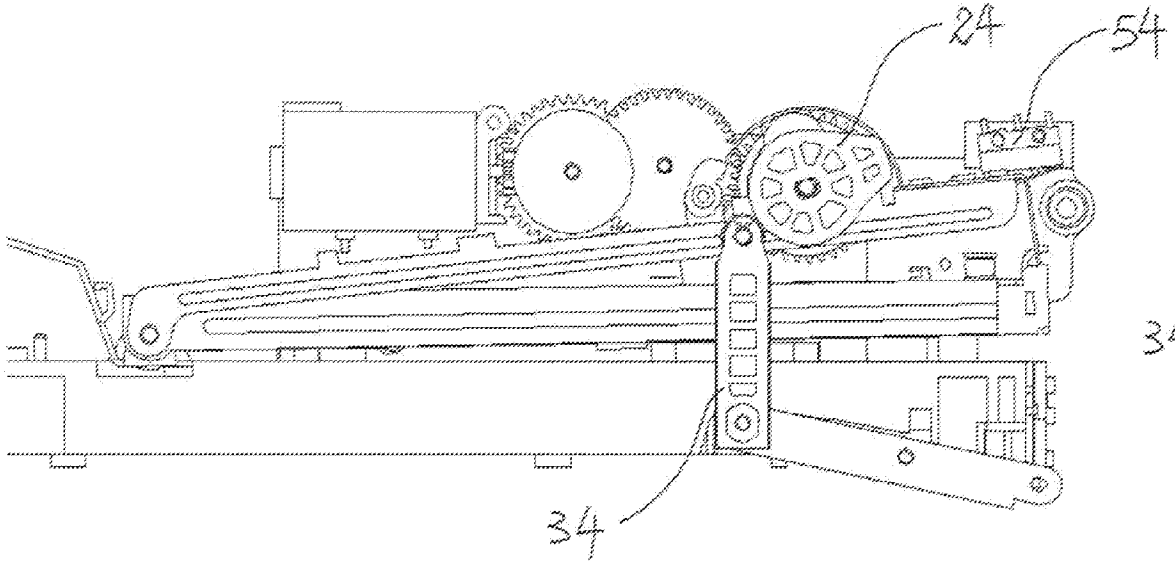
FIG. 10A is a side view of the stapler of FIG. 9A in a fifth configuration.

As shown in FIGS. 10A and 10B, when the cams 24 are further rotated in the same direction indicated by the arrow A in FIG. 2, the spring 46 returns the movement transmission assembly 30 to its stable position in which the legs 34 are in their upper position and the platelet 40 is in its lower position. During this return movement of the movement transmission assembly 30, the legs 34 move upwardly and the platelet 40 moves downwardly. The staple-bending anvils 44 are thus allowed to pivot back to their lower position on their own weight. The eccentrically mounted wheels 52 also move the magazine 14 and the stapling head 12 away from the base part 16 and away from each other, back to their respective upper initial position. When the stapling head 12 reaches its upper initial position, it activates a switch 54 to stop operation of the motor 20, whereupon the stapler 10 is ready for the next round of stapling operation.

It can be seen from the above that the rotation of the cams 24 from their initial position as shown in FIGS. 6A and 6B, consecutively through the position in FIGS. 7A and 7B, FIGS. 8A and 8B, FIGS. 9A and 9B, until they reach back to their initial position as shown in FIGS. 10A and 10B is smooth and continuous. This also means that the action of bending the staple legs follows the action of driving the staple through the pieces of sheet material to be stapled smoothly and continuously, with no sudden intermediate transition.

Figure 11A:
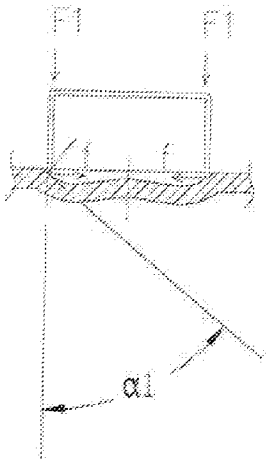
FIG. 11A is a schematic diagram of a conventional stapler at the time of bending legs of a staple.
Figure 11B:
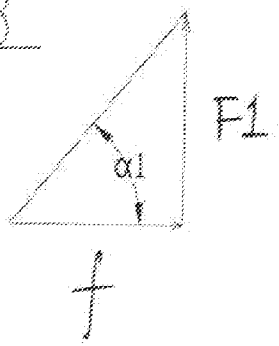
FIG. 11B is a force diagram of the conventional stapler in the configuration shown in FIG. 11A.
Figure 12A:
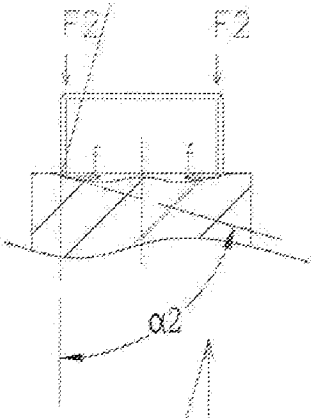
FIG. 12A is a schematic diagram of a conventional clinch stapler at the time of bending legs of a staple.
Figure 12B:
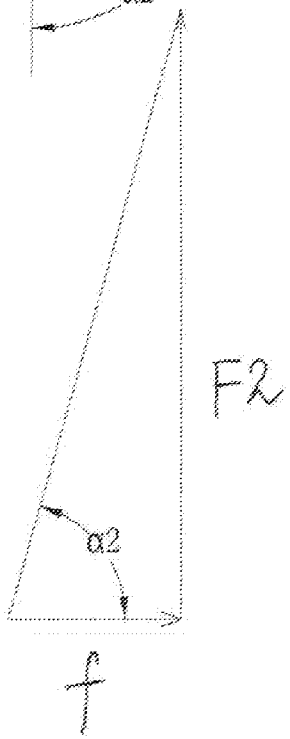
FIG. 12B is a force diagram of the conventional clinch stapler in the configuration shown in FIG. 12A.

As shown in FIGS. 11A and 11B, f is the horizontal force required to bend the legs of the staple when the base of a conventional stapler just touches the legs of the staple. F1 is the force required to exert on the staple to have its legs bent. As shown in FIGS. 12A and 12B, the horizontal force required to bend the legs of the staple when the base of a conventional clinch stapler just touches the legs of the staple is also f. However, as the requirement of a clinch stapler is that the legs of the staple are straight after bending, the angle $\alpha 2$ of the trough in the base part of a clinch stapler is larger than the angle $\alpha 1$ of the trough in the base part of a conventional stapler.

The force F1 required to be exerted on a staple to have its legs bent by a conventional stapler is $f \cdot \tan \alpha 1$. The force F2 required to be exerted on a staple to have its legs bent by a conventional clinch stapler is $f \cdot \tan \alpha 2$. As $\alpha 2 > \alpha 1$ and both $\alpha 1$ and $\alpha 2$ are less than 90°, $F2 > F1$.

Figure 13A:
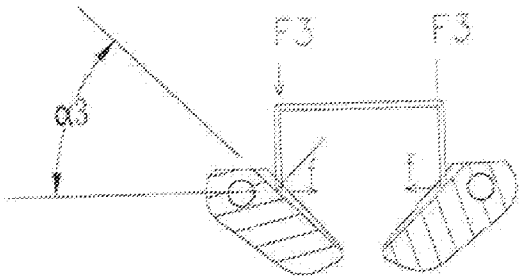
FIG. 13A is a schematic diagram of the stapler of the present invention at the time of bending legs of a staple.
Figure 13B:
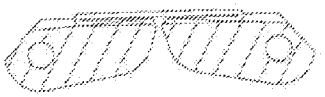
FIG. 13B is a schematic diagram of the stapler of the present invention after bending legs of a staple.
Figure 13C:
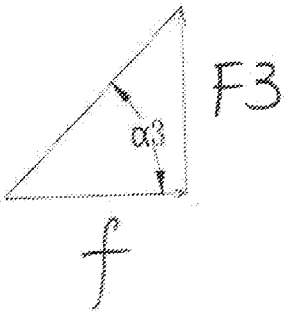
FIG. 13C is a schematic diagram of the stapler of the present invention when in the configuration shown in FIG. 13A.

Turning now to FIGS. 13A to 13C, when the anvils 44 of the stapler 10 according to the present invention are in their lower position (as shown in FIG. 13A), the angle $\alpha 3$ is smaller than both $\alpha 1$ and $\alpha 2$. The force F3 required to be exerted on a staple to have its legs bent by a stapler 10 according to the present invention is $f \cdot \tan \alpha 2$. As $\alpha 2 > \alpha 1 > \alpha 3$, $F2 > F1 > F3$. This means that the force F3 required of a user to operate the stapler 10 is the least as compared with that required for operating the conventional stapler and clinch stapler.

In addition, when the anvils 44 of the stapler 10 according to the present invention are in the upper position (as shown in FIG. 13B), the upper surfaces of the anvils 44 which act on the legs of the staple collectively form a "trough" which is substantially horizontal. This ensures that the legs of the staple are very straight after bending.

As discussed above, in the conventional clinch staplers, during the stapling actions, when the plate carried by the base part is retracted to expose a space, the staple which has been driven through the pieces of sheet material is further driven by the driver of the stapling head towards an anvil carried by and fixed relative to the base part, whereby the legs of the staple are bent in a quick action. It is found in practice that the quality of straight bending of the legs of the staples by such conventional clinch staplers is not stable. It should be noted that in particular in cases where the pile of pieces of sheet material through which the staple has been driven is thin, the staple may not be engaged fixedly to the staple magazine. Further driving the staple towards the base part by the stapling head may cause the staple (in particular its legs) to move in an undesired manner or direction, thus adversely affecting the straight bending effect.

On the other hand, in the present staple 10, during and just prior to the bending of the legs of the staple which has been driven through a pile of pieces of sheet material, the stapling head 12, the magazine 14 and the base part 16 are kept fixed and stationary relative to one another, and only the anvils 44 are pivoted towards each other and towards the legs of the staple to bend the legs of the staple. It is found that such provides a more reliable and consistent straight bending effect.

It should be understood that the above only illustrates an example whereby the present invention may be carried out, and that various modifications and/or alterations may be made thereto without departing from the spirit of the invention. It should also be understood that various features of the invention which are, for brevity, described here in the context of a single embodiment, may also be provided separately or in any appropriate sub-combinations.

The invention claimed is:

1. A stapler comprising:

a stapling head with a driver, a magazine adapted to carry at least one staple with two legs, a base part carrying at least two anvil members, a movement transmission assembly for moving said anvil members to bend said legs of said staple, and at least one actuator, wherein said stapling head, said magazine and said base part are movable relative to one another, wherein said actuator is movable from a first position to a second position to move said stapling head and said magazine relative to each other and relative to said base part such that the driver of said stapling head drives said staple away from said magazine, said actuator being movable from said first position to said second position by rotation in a first direction, wherein said actuator is movable from said second position to a third position to move the movement transmission assembly to move said anvil members to bend said legs of said staple, said actuator being movable from said second position to said third position by continued rotation in said first direction, wherein said actuator is movable from said third position back to said first position, by continued rotation in said first direction, wherein said actuator is rotatable in said first direction about an axis fixed relative to said stapling head.

2. A stapler according to claim 1 wherein said actuator includes at least one cam member and/or at least one wheel member.

3. A stapler according to claim 1 wherein said actuator is movable from said third position to a fourth position to move said stapling head and said magazine away from said base part.

4. A stapler according to claim 1 wherein said stapler is electrically operated.

5. A stapler comprising:

a stapling head with a driver, a magazine adapted to carry at least one staple with two legs, a base part carrying at least two anvil members, a movement transmission assembly for moving said anvil members to bend said legs of said staple, and at least one actuator, wherein said stapling head, said magazine and said base part are movable relative to one another, wherein said actuator is movable from a first position to a second position to move said stapling head and said magazine relative to each other and relative to said base part such that the driver of said stapling head drives said staple away from said magazine, wherein said actuator is movable from said second position to a third position to move the movement transmission assembly to move said anvil members to bend said legs of said staple, and, wherein said movement transmission assembly comprises a first part, a second part and a third part which are pivotally connected with and pivotally movable relative to one another.

6. A stapler according to claim 5 wherein said second part of said movement transmission assembly is pivotally movable about an axis fixed relative to said base part.

7. A stapler according to claim 5 wherein, during movement of said actuator from said second position to said third position, said first part of said movement transmission assembly moves in a first direction and said third part of said movement transmission assembly moves in a second direction which is substantially opposite to said first direction.

8. A stapler according to claim 7 wherein movement of said third part of said movement transmission assembly in said second direction moves said anvil members to bend said legs of said staple.

9. A stapler according to claim 5 wherein said stapler is electrically operated.

10. A stapler according to claim 5 wherein said actuator is movable from said third position to a fourth position to move said stapling head and said magazine away from said base part.

11. A stapler according to claim 10, further including a spring member which, during said movement of said stapling head and said magazine away from said base part, is adapted to move said movement transmission assembly, whereupon said first part of said movement transmission assembly moves in said second direction and said third part of said movement transmission assembly moves in said first direction.

12. A stapler according to claim 5 wherein said first part of said movement transmission assembly is directly connected with said second part of said movement transmission assembly and said third part of said movement transmission assembly is directly connected with said second part of said movement transmission assembly.

* * * * *